United States Patent [19]

Lanting et al.

[11] 4,319,520

[45] Mar. 16, 1982

[54] AIR FLOW FLOOR PANEL

[75] Inventors: Richard J. Lanting, Kentwood; Robert J. Munsey, Caledonia, both of Mich.

[73] Assignee: Westinghouse Electric Corp., Pittsburgh, Pa.

[21] Appl. No.: 110,279

[22] Filed: Jan. 7, 1980

[51] Int. Cl.[3] ..... E04B 5/48

[52] U.S. Cl. ..... 98/37; 52/126; 52/794; 52/815; 98/40 R; 98/41 SV

[58] Field of Search ..... 34/237; 52/126, 263, 52/794, 815; 98/32, 33, 36, 37, 39, 40 R, 41 SV, 55, 114, 115 R

[56] References Cited

U.S. PATENT DOCUMENTS

| | | | |
|---|---|---|---|
| 941,413 | 11/1909 | Hart . | |
| 2,055,339 | 9/1936 | Dalton . | |
| 2,153,320 | 4/1939 | Venzie | 52/794 X |
| 2,912,918 | 11/1959 | Mead | 98/115 R |
| 3,021,916 | 2/1962 | Kemp . | |
| 3,067,843 | 12/1962 | Rushtoh et al. . | |
| 3,097,587 | 7/1963 | Kurek | 98/36 |
| 3,150,748 | 9/1964 | Liskey, Jr. | 52/126 X |
| 3,229,609 | 1/1966 | Larson et al. | 98/36 |
| 3,236,018 | 2/1966 | Graham et al. | |
| 3,367,257 | 2/1968 | Raider et al. | 98/40 DX |
| 3,487,766 | 1/1970 | Wood | 98/31 |
| 3,497,079 | 2/1970 | Kulwiel . | |
| 3,548,559 | 12/1970 | Levine et al. | |
| 3,780,503 | 12/1973 | Smith | 98/41 SV X |
| 3,996,845 | 12/1976 | Harris | 98/114 |
| 4,084,366 | 4/1978 | Saylor et al. | 52/794 |

FOREIGN PATENT DOCUMENTS

| | | | |
|---|---|---|---|
| 324777 | 10/1957 | Switzerland | 52/815 |

*Primary Examiner*—Albert J. Makay
*Assistant Examiner*—Harold Joyce
*Attorney, Agent, or Firm*—B. R. Studebaker

[57] ABSTRACT

An air flow floor panel for a raised access floor system which includes an articulated frame surrounding a light weight grid component in egg-crate form. A laminated top plate having a plurality of holes therethrough is welded to the articulated frame and grid component and a pair of relatively slidable damper plates are secured to the bottom edge of the articulated frame by a plurality of S-shaped clips.

15 Claims, 6 Drawing Figures

FIG. 2
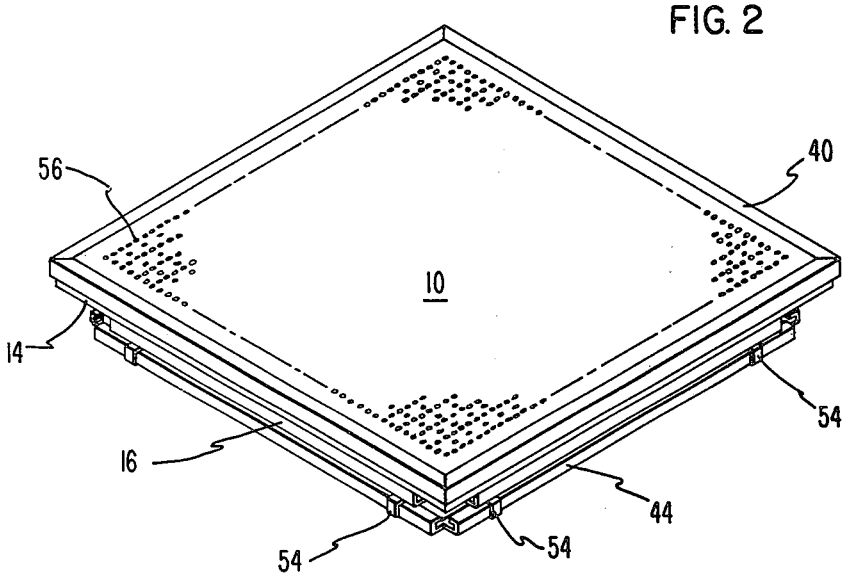
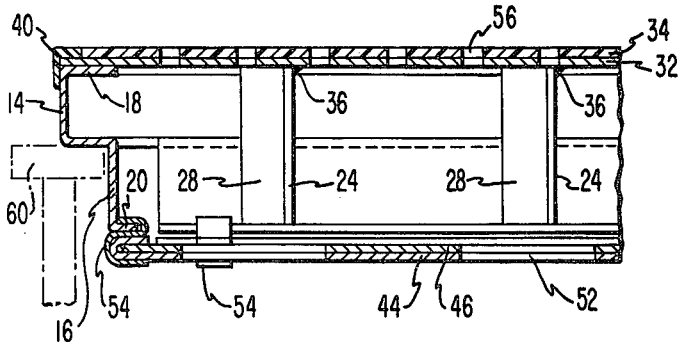
FIG. 4

AIR FLOW FLOOR PANEL

BACKGROUND OF THE INVENTION

This invention relates to floor panels for use in a raised acces flooring system and more particularly to an air flow floor panel with a high strength to weight ratio.

Raised access flooring systems are used in several situations. When it is necessary that air conditioning, heating and electrical systems be located beneath the floor as opposed to in a plenum area above the ceiling of a room it is necessary that a pedestal type raised access floor system be employed. When the heating and air conditioning plenum is located below this raised access floor it is also necessary that certain of the panels permit air flow therethrough and, although the majority of the floor panels can be solid in these situations, certain of the floor panels must provide air flow into the room above the floor. In addition, in a clean room situation where vertical laminar flow is required the entire floor structure may be required to provide air flow therethrough. In the past, in some instances, a simple non-load bearing register was employed to provide air conditioning and heating to the room. These non-load bearing structures, however, limit the location of office furniture and the like as well as traffic patterns through the room and generally must be located adjacent a wall to remove them from any future pedestrian traffic patterns. In an effort to provide light weight structurally sound floor panels several different construction methods have been employed. In U.S. Pat. No. 3,236,018 to D. C. Graham et al. support was provided by bending portions of the bottom sheet into vertically oriented struts to provide a truss like construction by welding each of the bent portions of the bottom sheet to the top plate. In another construction disclosed in U.S. Pat. No. 3,067,843 to F. N. Rushtoh et al. a plurality of integral underlying spaced bearing bars or ribs of inverted T-shape depend from the floor panel top plate and are supported by a plurality of transverse I-beams which extend perpendicular to the bearing bars. Each of the foregoing prior art structures require a significant number of welds which increases the cost of manufacturing and employ rather heavy gauge steel tp provide sufficient strength and therefore a heavier and more expensive panel to manufacture. A floor panel is needed that is strong enough to support heavy office machinery and be particularly resistant to deformation and deflection under loads of up to 250 pounds per square foot. Furthermore, a high strength to weight ratio is an important criteria even where air flow through a perforated top sheet is necessary.

SUMMARY OF THE INVENTION

In accordance with the present invention a raised access flooring air flow panel is provided with a good strength to weight ratio by employing an articulated frame having at least upper and lower inwardly directed flanges and an interfitted grid structure surrounded by the articulated frame. A top plate is welded to both the upper inwardly directed flange of the articulated frame and at predetermined locations on the grid structure. The articulated frame includes an upper inwardly directed C-shaped portion and a lower inwardly directed L-shaped portion with the upper end of the L-shaped portion depending downwardly from the innermost edge of the bottom leg of the C-shaped portion. Damper means including a pair of relatively slidable, apertured, planar panels are secured to the lower inwardly directed flange on the articulated frame by a plurality of S-shaped clips. The interfitted grid structure includes a plurality of individually slotted members having their slots interfitted to form an egg crate structure with the upper and lower edges of each of the individual slotted members falling in spaced parallel planes. The top plate may be a laminate including a steel base portion welded to the upper flange of the articulated frame and the grid structure, and a high pressure plastic laminate cemented to the top of the steel base portion. The top plate may also be provided with a plurality of decoratively spaced apertures which extend therethrough to provide air flow from beneath the panel into the room above the floor.

BRIEF DESCRIPTION OF THE DRAWING

Many of the attendant advantages of the present invention will become more readily apparent and better understood as the following detailed description is considered in connection with the accompanying drawing in which:

FIG. 2 is an isometric view of the floor panel of FIGS. 1A and 1B.

FIG. 4 is a sectional view taken along the line IV—IV of FIG. 3.

DESCRIPTION OF THE PREFERRED EMBODIMENT

Figure 1A:
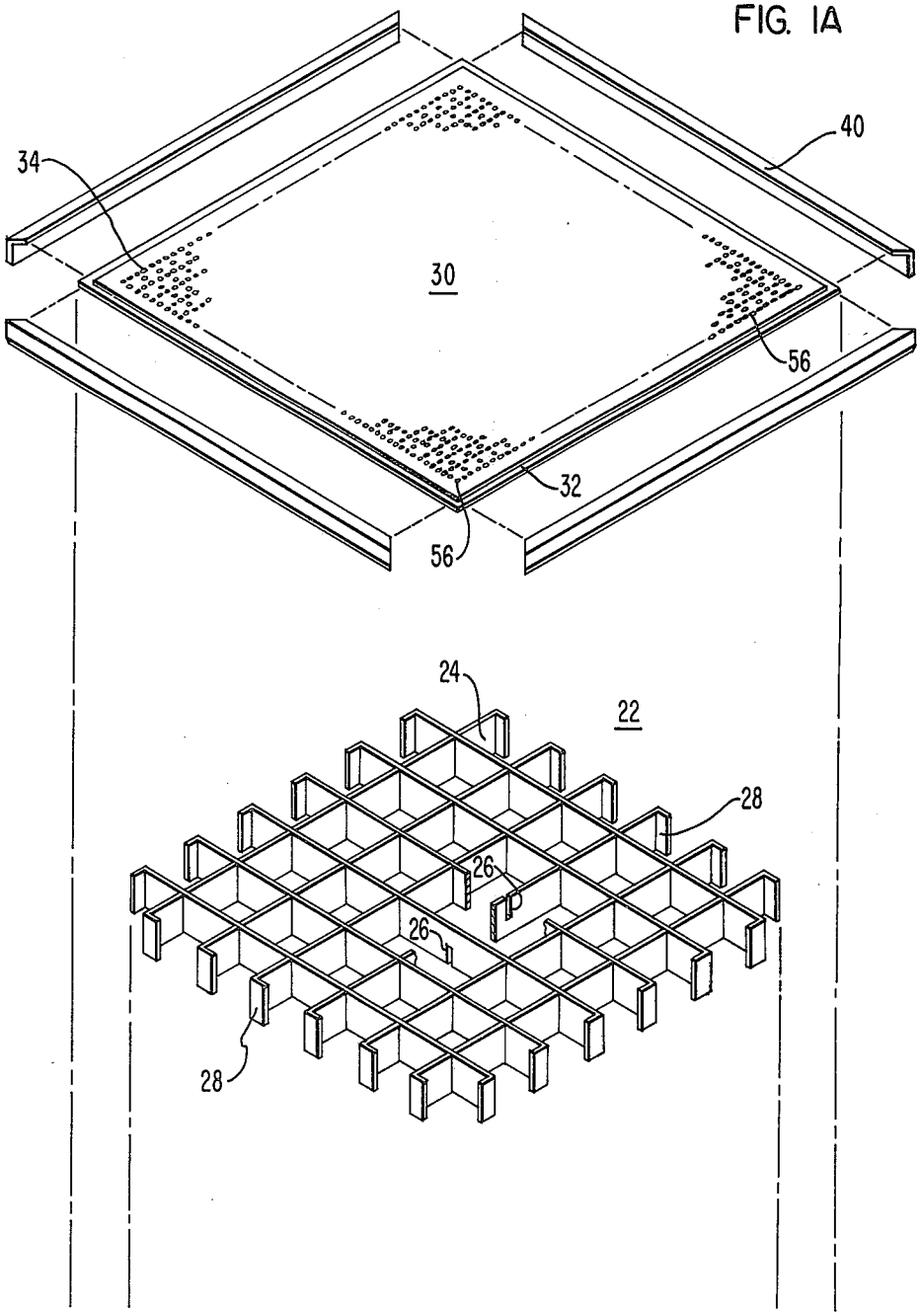
FIGS. 1A and 1B are an exploded view of the air flow floor panel of this invention.
Figure 1B:
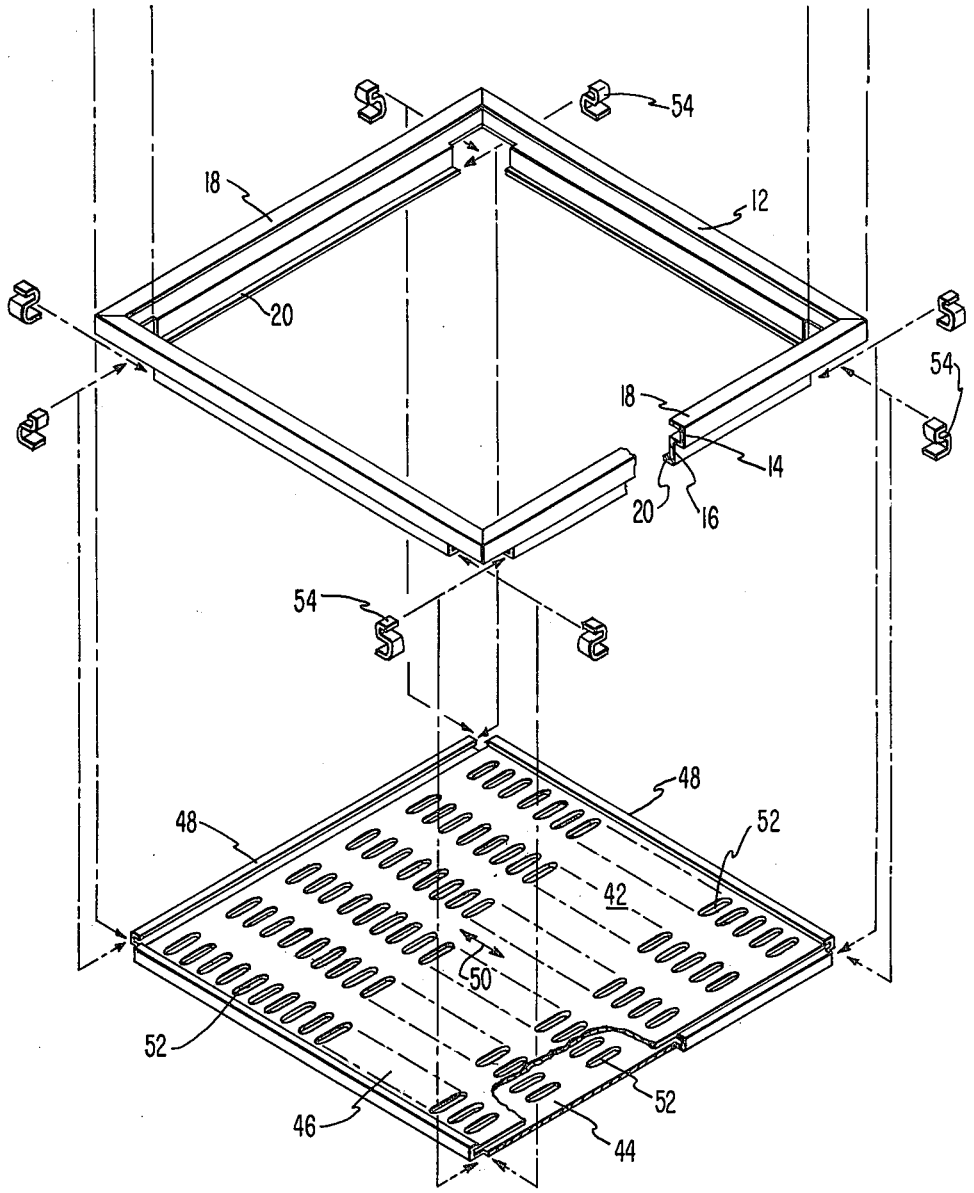

Referring now in detail to the drawing wherein like reference characters represent like parts throughout the several views, there is illustrated in FIGS. 1A and 1B an exploded view of the various parts which make up the air flow floor panel illustrated in an assembled form in FIG. 2. The air flow floor panel generally designated 10 includes an articulated steel frame 12 which in cross section is generally defined by an inwardly directed C-shaped portion 14 with an inwardly directed L-shaped portion 16 depending from the inwardly directed end of the bottom leg of the C-shaped portion 14. The upper leg of the C-shaped portion 14 defines an inwardly directed flange 18 while the inwardly directed bottom leg of the L-shaped portion 16 defines a lower inwardly directed flange 20.

A grid structure generally designated 22 which is composed of a plurality of individual slotted members or slats 24 having slots 26 therein and foot plates 28 at each end thereof are interfitted by means of their slots 26 to form an egg crate structure in which the upper and lower edges of each of the individual slotted members fall in a pair of spaced parallel planes. As a specific example, and as illustrated in FIG. 1A twelve of the individual slotted members are associated together six in each direction by means of their interlocking slots 26 to form the grid structure 22. The articulated frame 12 surrounds the grid structure 24 and each is assembled by welding to a laminated top plate generally designated 30 which includes a steel base portion 32 and a high pressure plastic laminate portion 34 which is cemented to the top of the steel base portion 32.

Figure 3:
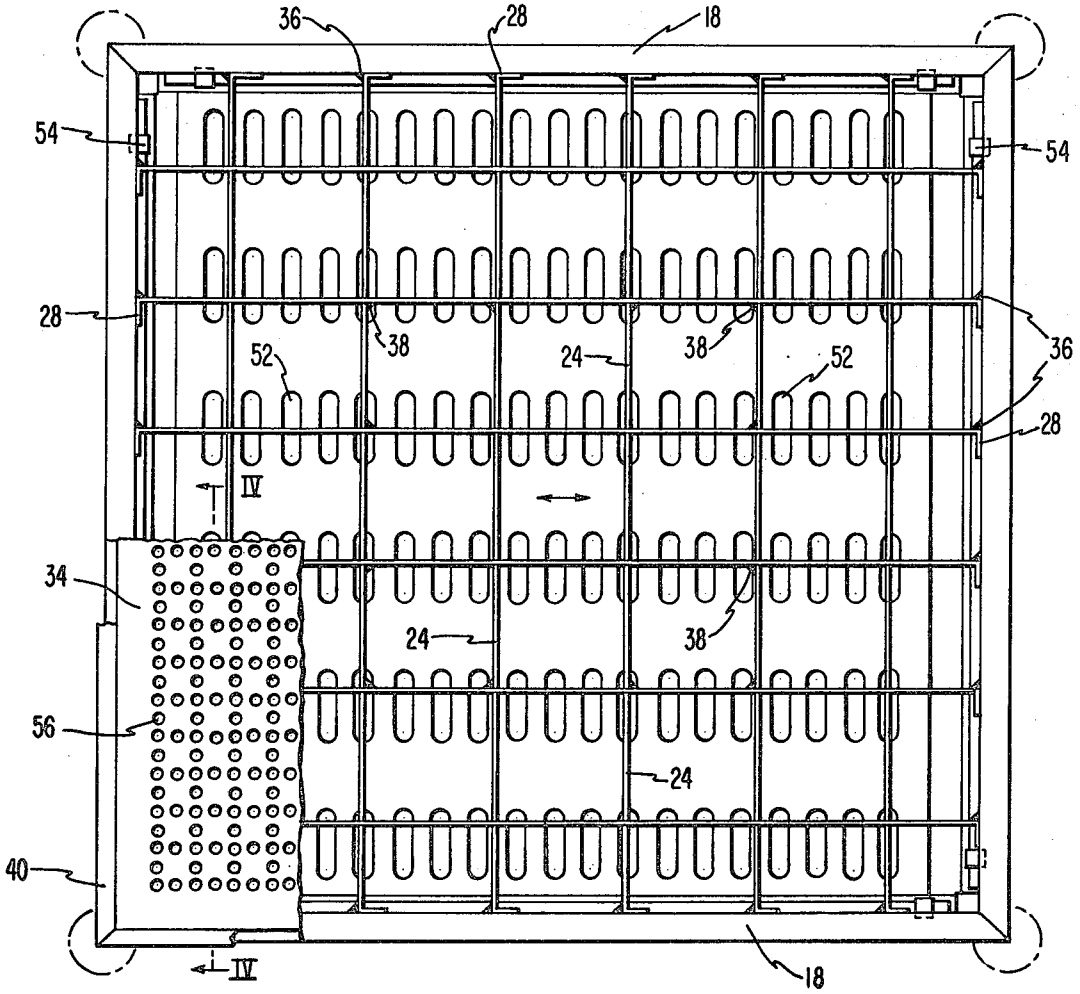
FIG. 3 is a top plan view of the air flow floor panel of this invention with a substantial portion of the top plate broken away.

It has been found that it is unnecessary to weld each of the intersections of the grid structure to the top plate 30 and that welds need only be made between the grid struture, articulated frame and the top plate at their intersections as indicated at 36 (FIGS. 3 and 4) and at intermediate locations between the grid structure and the top plate as indicated at 38. This inner group of welds 38 define a box-like structure halfway between the center of the panel and the periphery.

The panel further includes vinyl trim which overlies the upper end of the articulated frame 12 and the top plate 30. This edge trim may be cemented thereto or alternatively, the steel portion 32 of the top plate can extend slightly beyond the articulated channel and the vinyl trim may be designed with a groove to receive and grip the over extending edge of the steel portion 32 of the top plate 30.

Damper means, generally designated 42 includes a pair of relatively slidable apertured planar panels 44 and 46. The bottom panel 44 includes a peripheral upwardly extending inwardly directed channel portion 48 which serves to mount the damper means as well as confine the upper apertured planar panel 46 for relative slidable movement with respect to the lower panel 44 in the direction indicated by the arrow 50. Each of the planar panels include the apertures 52 therethrough, and as will be apparent the relative position of the lower damper plate 44 with respect to the upper panel 46 will control the amount of air which can flow through the air flow floor panel 10. The damper means 42 is secured to the bottom of the articulated frame 12 by means of a plurality of S-shaped clip members 54. The lower curved portion of the S-sphaed clip 54 surrounds the raised peripheral channel 48 of the damper means while the upper curved portion of the S-shaped slip 54 slips over and grips the inwardly extending bottom leg 20 of the L-shaped portion of the articulated frame 12. These S-shaped clips securely but rèleasably fasten the damper means to the floor panel without the need for welds, screws, or other more permanent types of securing means.

With the facility for the simple and releasable attachment of the damper means to the air flow floor panel of this invention, the panel can be used with or without damper means as the situation and use dictates.

To complete the air flow characteristics of the panel the top plate which is a laminate of the steel base portion 32 and the high pressure plastic laminate 34 is provided with a plurality of apertures 56 therethrough and the apertures 56 can be decoratively spaced to provide an improved appearance to the air flow floor panel 10.

In the preferred embodiment, the top plate 32 may comprise 14 gauge electrogavanized steel while the articulated frame is preferably 16 gauge steel and the grid component also of 16 gauge steel which in combination provides a relatively light weight but strong floor panel because of the superior strength provided by the egg crate-like structure. Furthermore, specific control can be provided for the amount of air flow through the panel by the relative positioning of the apertures 52 in the upper damper plate 46 relative to the apertures 52 in the lower damper plate 44 at almost an infinite number of settings and therefore a widely variable amount of air flow.

Figure 5:
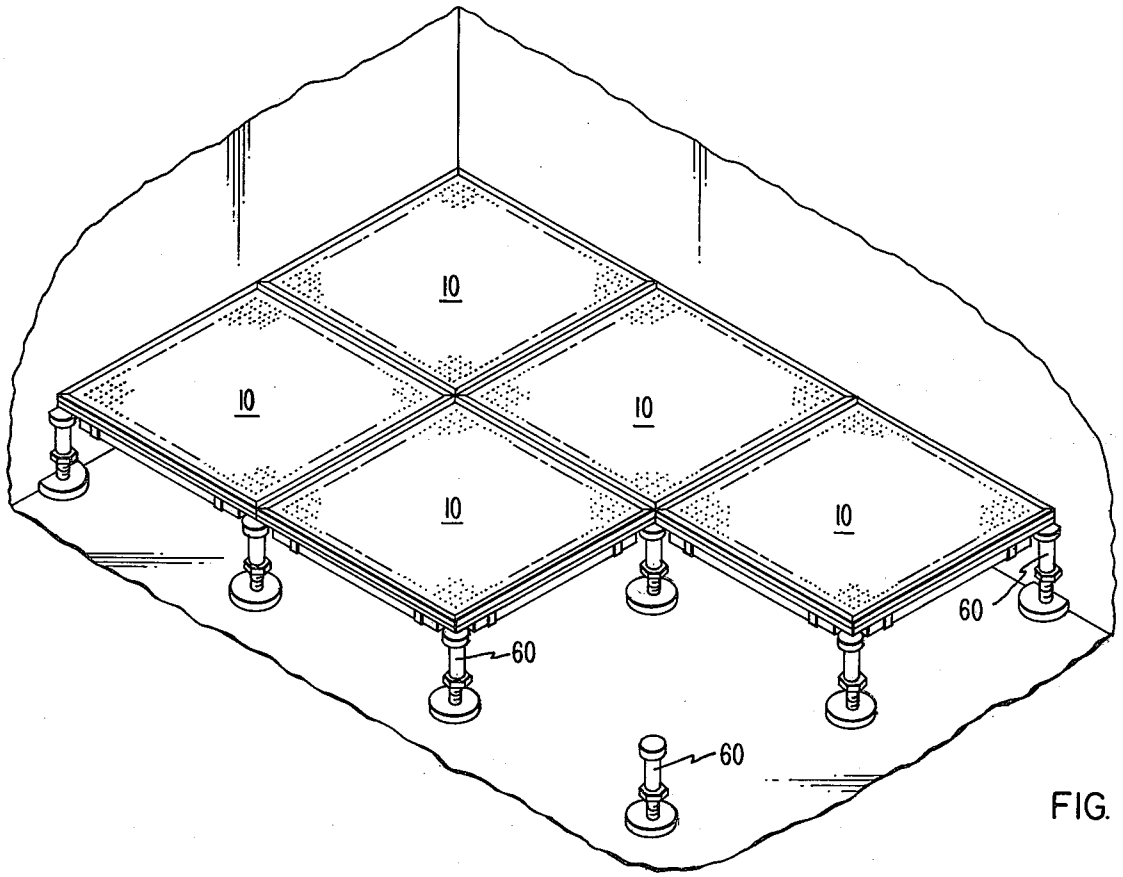
FIG. 5 is an isometric view illustrating the use of the air flow floor panel of this invention in a room.

As illustrated in FIG. 5, the air flow floor panel 10 may be employed in a typical raised flooring system supported by a plurality of conventional floor support pedestals 60 wherein all of the floor panels are of the air flow type or, alternatively the air flow panels may be used selectively in a system wherein the majority of the floor panels include a carpeted upper surface.

What is claimed is:

1. An air flow panel for use in a raised access flooring system comprising:

an articulate frame having at least upper and lower inwardly directed flanges;

an interfitted grid structure surrounded by said articulated frame;

a top plate having a plurality of apertures therethrough welded to both said upper inwardly directed flange on said articulated frame and at predetermined locations on said grid structure; and damper means secured to said lower inwardly directed flange on said articulated frame.

2. The air flow floor panel according to claim 1 wherein said articulated frame includes an upper inwardly directed C-shaped portion and a lower inwardly directed L-shaped portion with the upper end of said L-shaped portion depending downwardly from the innermost end of the bottom edge of said C-shaped portion.

3. The air flow floor panel according to claim 1 wherein said damper means includes a pair of relatively slidable apertured planar panels and a plurality of S-shaped clips secure said damper means to said lower inwardly directed flange on said articulated frame.

4. The air flow floor panel according to claim 2 wherein said damper means includes a pair of relatively slidable apertured planar panels secured to said bottom leg of the lower inwardly directed L-shaped portion of the articulated frame by a plurality of S-shaped clips.

5. The air flow floor panel according to claim 1 wherein said interfitted grid structure includes a plurality of individual slotted member having their slots interfitted to form an egg crate structure with the upper and lower edges of each of said individual slotted members falling in spaced parallel planes.

6. The air flow floor panel according to claim 1 wherein said top plate is a laminate including a steel base portion welded to said upper flange of said articulated frame and said grid structure and a high pressure plastic laminate cemented to the top of said steel base portion.

7. In an air flow panel according to claim 1 wherein said top plate is welded to said articulated frame and said grid structure at their intersections and at intermediate locations between the grid structure and the top plate which form a box-like pattern halfway between the center of the panel and the periphery.

8. An air flow panel for use in a raised access flooring system comprising:

a metal structural framework constructed from interfitting planar members to form a grid structure;

an articulated frame having at least upper and lower inwardly directed flanges surrounding said structural framework;

a top plate having a plurality of apertures therethrough welded to the upper inwardly directed flange on said articulated frame and at predetermined locations to said metal structural framework; and damper means secured to the lower inwardly directed flange on said articulated frame.

9. The air flow floor panel according to claim 8 wherein said articulated frame includes an upper inwardly directed C-shaped portion and a lower inwardly directed L-shaped portion with the upper end of said L-shaped portion depending downwardly from the innermost end of the bottom edge of said C-shaped portion.

10. The air flow floor panel according to claim 8 wherein said damper means includes a pair of relatively slidable apertured planar panels and a plurality of S-shaped clips secure said damper means to said lower inwardly directed flanges on said articulated frame.

11. The air flow floor panel according to claim 9 wherein said damper means includes a pair of relatively slidable apertured planar panels and a plurality of S-shaped clips secure said damper means to said bottom leg of the lower inwardly directed L-shaped portion of the articulated frame.

12. The air flow floor panel according to claim 8 wherein said structural framework includes a plurality of individual slotted members having their slots interfitted to form an egg crate structure with the upper and lower edges of each of said individual slotted members falling in spaced parallel planes.

13. The air flow floor panel according to claim 8 wherein said top plate is a laminate including a steel base portion welded to said upper flange of said articulated frame and said grid structure and a high pressure plastic laminate cemented to the top of said steel base portion.

14. The air flow floor panel according to claim 8 wherein said plurality of apertures extending through said top plate are decoratively spaced.

15. In an air flow panel according to claim 8 wherein said top plate is welded to said articulated frame and said structural framework at their intersections and at intermediate locations between the structural framework and the top plate which form a box-like pattern halfway between the center of the panel and the periphery.

* * * * *